US006412188B1

(12) United States Patent
Bates et al.

(10) Patent No.: US 6,412,188 B1
(45) Date of Patent: Jul. 2, 2002

(54) METHOD AND APPARATUS FOR DRYING WOOD STRANDS

(76) Inventors: Elton Bates, 115 W. Jefferson St., Doniphan, MO (US) 63935; Richard J. Gobel, P.O. Box 12401, Millcreek, WA (US) 98082

( * ) Notice: Subject to any disclaimer, the term of this patent is extended or adjusted under 35 U.S.C. 154(b) by 0 days.

(21) Appl. No.: 09/727,626

(22) Filed: Dec. 1, 2000

Related U.S. Application Data

(60) Provisional application No. 60/168,800, filed on Dec. 2, 1999.

(51) Int. Cl.[7] ..... F26B 21/06
(52) U.S. Cl. ..... 34/78
(58) Field of Search ..... 34/78, 379, 423, 34/467, 477, 487, 514; 432/72

(56) References Cited

U.S. PATENT DOCUMENTS 5,588,222 A 12/1996 Thompson

*Primary Examiner*—Teresa Walberg
*Assistant Examiner*—Vinod D. Patel
(74) *Attorney, Agent, or Firm*—Polster, Lieder, Woodruff & Lucchesi, LC

(57) ABSTRACT

Apparatus (10) for drying particles derived from wood such as sawdust, wafers, flakes, paper sludge, and strands. The wood particles are introduced into a first drying stage (12) and conveyed through a dryer (16) in which the wood particles are heated to an elevated temperature (900 F.) to drive off moisture and VOC's from the particles. The wood particles are then delivered to a second drying stage (14) through which they are also conveyed. The particles are now heated to a second elevated temperature (600 F.) to substantially eliminate any moisture in the particles so the particles can now be used to make wood products. A heating system includes a combustion chamber (22) to combust fuel to commonly heat the wood particles in both drying stages. The heating system includes a separator (28) for collecting the VOC's driven off from the particles in the first drying stage so the VOC's can be heated in the combustion chamber to a temperature at which they breakdown into shorter chain hydrocarbons which are readily combusted. This substantially eliminates any VOC's which might otherwise be exhausted to the atmosphere.

20 Claims, 1 Drawing Sheet

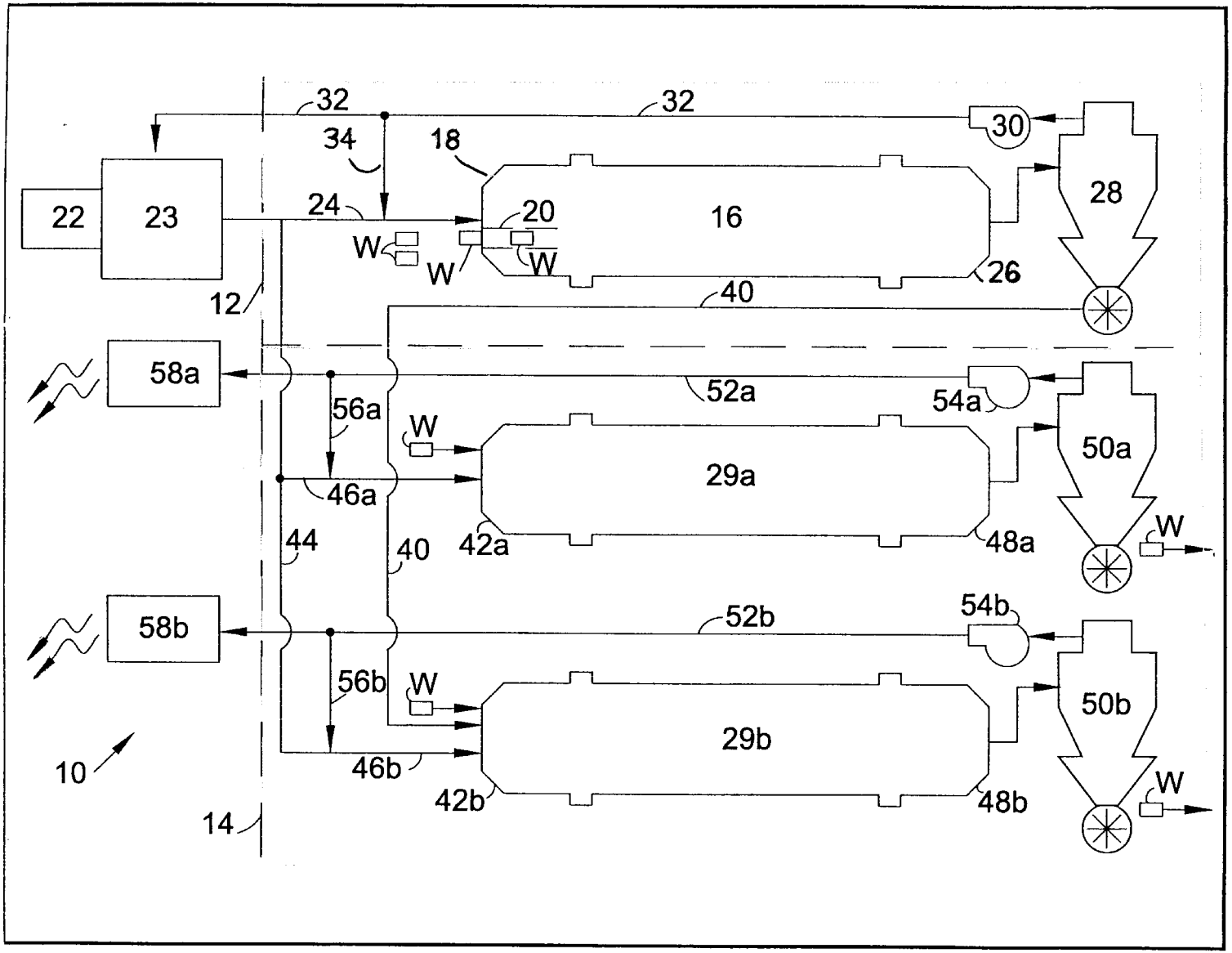
28
30
26
16
40
32
20
W
18
34
24
22
23
12
58a
58b
10
14
50a
50b
54a
54b
48a
48b
52a
52b
29a
29b
42a
42b
56a
56b
46a
46b
44

METHOD AND APPARATUS FOR DRYING WOOD STRANDS

CROSS REFERENCE TO RELATED APPLICATIONS

This application is based upon U.S. Provisional Patent application No. 60/168,800 filed Dec. 2, 1999.

STATEMENT REGARDING FEDERALLY SPONSORED RESEARCH OR DEVELOPMENT

BACKGROUND OF THE INVENTION

This invention relates to drying particles derived from wood such as sawdust, wafers, flakes, paper sludge, or strands and more particularly to a method and apparatus of drying wood strands in which the amount of volatile organic compounds (VOC's) produced during the drying process is reduced to an amount significantly below EPA maximum allowable requirements. The invention described herein achieves the desired reduction in VOC's using significantly less energy than is possible with existing technology.

The wood particles referred to above commonly vary in size from a 0.005" diameter dust particle to a wood strand or flake generally 0.030–0.050 inches thick, approximately 1 inch wide and varying in length up to 15" long. The longer strands are typically used in making particle board, oriented strand board or similar wood construction products. In the case of sludge, the particles are more globular in shape with varying cross-sections and dimensions. In all instances, the materials cannot be used to make the different wood products because of their moisture content. The moisture content of sludge particles is typically 65% or greater (on a wet basis). Particles derived from wood pieces typically have moisture contents of 40–50% on a wet basis. Because they cannot be used when their moisture content is so high, they are subjected to a drying process by which the moisture content is reduced to approximately 2%.

Various wood drying processes are known in the art. A traditional process involves placing the wood strands in a multi-pass dryer. In this process, fuel is burned in a combustion chamber to produce a hot gas which is circulated through the dryer so to heat the wood strands to a temperature sufficiently high to drive out the moisture in the strands. Alternatively, the hot gases are used to heat oil, which is pumped to heat exchangers where air is heated. The hot air is then used for drying the wood, the net result in the dryer being the same.

An additional process consists of loading strands onto a conveyor belt or the like and moving them through the dryer at a speed slow enough to insure that the strands are heated to a desired temperature. The dryer can be a multi-pass type dryer in which instance the conveyor either follows a serpentine path through the dryer so the wood strands are exposed to heat for a long period of time, or the strands are off-loaded from one conveyor, after exiting the dryer, and then onto another conveyor which is routed back through the dryer. It will be understood that in a multi-pass drying system, the conveyor may have three or four segments extending through the dryer, or the strands may be moved to three or four separate conveyors as part of the drying process.

An alternate drying process is shown, for example, in U.S. Pat. No. 5,588,222. Here, there is a first drying stage involving one dryer, and second drying stage involving two or more separate dryers. Each dryer has its own separate fuel combustion chamber with which it is coupled. All of the wood strands are fed through the first drying stage and heated by a hot gas produced by the first combustion chamber. At the end of this first stage, the wood strands and hot gas are separated from each other. A portion of the wood strands are then routed to the dryers comprising the second drying stage. A portion of the hot gas is now recirculated to the first combustion chamber, while the remainder of the gas is routed to the burners and combustion chambers for the other dryers. There the hot gas is combined with other heated gases produced by the respective combustion chambers for the second stage dryers and blown over the strands being moved through the respective second stage dryers. At the end of the second stage dryers, the wood strands are fed off to their next process stage, and the hot gases are vented.

BRIEF SUMMARY OF THE INVENTION

Among the several objects of the present invention may be noted the provision of apparatus for drying wood particles or strands having a high moisture content. The apparatus comprises a two-stage drying system specifically designed to significantly reduce VOC's produced while reducing the moisture content of wood particles or strands processed through the system. The apparatus requires significantly overall less energy (dehydration and VOC abatements) than current technology. The first stage of the system employs a rotary dryer into which wood pieces are introduced with hot gases produced by a burner and combustion chamber circulating through the rotary dryer as the wood passes through it. After removal from the rotary dryer, the wood pieces and gases are separated with the wood pieces being directed to the inputs of one or more second stage dryers as determined by the mass flow requirements for the system. The gases and VOC's are recycled back to the combustion chamber and re-burned. This re-burning, which occurs at a high temperature breaks down the VOC's into constituent gases which are readily combusted. This reduces the amount of VOC's generated during the drying process to a level which meets or is less than the EPA maximum allowed. Hot gases for further drying of the wood pieces in the second stage dryer(s) are supplied form the same combustion chamber which supplies the hot gases to the first stage dryer so only one combustion chamber is required to provide all of the heating requirements of the system. At completion of the second stage of drying, the wood pieces leave the dryer with most of their moisture removed so the wood strands are now available for use in other processes.

BRIEF DESCRIPTION OF THE SEVERAL VIEWS OF THE DRAWINGS

The sole drawing FIGURE is a schematic representation of the system of the invention.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Referring to the drawing, applicants' apparatus comprises a two-stage system indicated generally 10. The first stage of the system, indicated generally 12, is a pre-drying stage. The second stage, indicated generally 14, is a finish drying stage. The purpose and function of applicants' system is two-fold.

First, the system is capable of drying out wood particles such as wood strands. These initially have a moisture content on the order of 50–55% on a wet basis. Second, it is known that in wood drying processes, air polluting compounds are entrained with flue gases such as volatile organic compounds (VOC'S) and are included with the total organic compounds (TOC's) produced. The EPA has established limits on the amount of VOC's and TOC's which can be produced, and it is a problem with conventional drying processes that the amount of VOC's produced exceed these limits. Applicants' two-stage system, as disclosed herein, does not.

The first stage 12 of the system utilizes a dryer 16 which is a rotary dryer. The front end 18 of the dryer includes a chute 20 by which wood strands W are loaded into the dryer. The wood strands may be individual pieces or small clumps of strands. At the end of chute 20, the wood strands are picked-up by various flightings (not shown) within the rotary dryer and conveyed through the dryer. Heat to dry the wood is supplied by a burner 22 through a combustion chamber 23 in which fuel is combusted to generate hot gases. The fuel combusted in burner 22 and combustion chamber 23 includes wood bark and fines, waste wood, propane, or natural gas. The resulting heated gases are supplied to dryer 16 through a piping system indicated generally 24.

It is an important feature of the invention that the first stage of the drying process involves very high temperatures, while the second stage of the process involves lower temperatures. This is because applicants' system is designed to remove VOC'S during the first stage of the drying process while also removing some of the moisture from the wood strands. Approximately 20% of the moisture content of the wood is removed in the first stage of applicants' system. The majority of the moisture content of the wood, approximately 75% is removed during the second stage of operation.

At inlet 18 of dryer 16, the temperature of the heated gases is on the order of 900° F. As the wood strands pass through the dryer (which varies in length based on production required), the gases' temperature gradually falls until the temperature at an outlet 26 of the dryer is between 200°–300° F. Operating the first stage dryer at such high inlet temperatures causes VOC's in the wood strands to be driven out (boiled off). The VOC's are gaseous emissions and these emissions become entrained with the hot gases used to heat the wood strands and so to now flow through the dryer stage together with the gases and wood particles.

At the outlet of dryer 16, the wood and gases are emptied into a cyclone separator 28. In the separator, the wood pieces fall to the bottom of the separator, while the gases and entrained VOC's rise to the top of the separator. Wood extracted from the separator now has a moisture content which has been reduced to approximately 30%–35% on a wet basis. This wood is now divided and separately supplied to one of two finish dryer's 29*a,* 29*b* which are used in the second stage 14 of the drying process. The gases and VOC's are drawn from the top of cyclone separator 28 by a fan 30 installed in a return line 32 to burner 22 or combustion chamber 23. Fan 30 draws the gases and VOC's back to combustion chamber 23 for further combustion with other fuel combusted in the chamber. A by-pass line 34 allows some of the return gases to bypass the burner and be reintroduced directly into front end 18 of dryer 16 via piping 24. These by-pass gases reintroduced into the front end of the dryer control the temperature at the dryer inlet.

As is well-known in the art, VOC's are a hydrocarbon. By feeding the VOC's driven off from the wood strands back into the burner or combustion chamber, the VOC's will break down under the high heat and oxidation which occurs within the burner to shorter chain hydrocarbons, turpentine for example, which are readily burned off. Accordingly, our invention allows the extracted VOC's to be substantially eliminated in burner 22 or combustion chamber 23 rather than escaping into the atmosphere as happens in conventional wood drying processes.

The wood strands extracted from separator 28 are conveyed by a conveying system 40 to the respective inlets 42*a,* 42*b* of two finish dryers 29*a,* 29*b.* Importantly, the two second stage dryers do not have separate combustion chambers or burners associated with them. Rather, the hot gases circulated through these two units to complete the drying process are supplied from the same burner 22 and combustion chamber 23 which supplies first stage dryer 16. The heated gases produced by burner 22 are supplied to the inlet of each of the second stage dryers by a main gas line 44 which is fed off of piping system 24, and individual gas feeder lines 46*a,* 46*b* which extend from line 44 to the inlet of the respective dryers 29*a,* 29*b.*

At the inlet end of each second stage dryer, the temperature is on the order of 700° F. At the outlet 48*a,* 48*b* of the respective dryers, the temperature is again on the order of 200–300° F. When the wood strands reach the outlet of the dryers, their moisture content has been reduced to approximately 2%.

The wood strands and hot gases from the outlet of each second stage dryer are now directed into a separator, there being a separate separator 50*a,* 50*b* respectively, for each second stage dryer. Now, the dried wood strands are removed from the bottom of the separators and are conveyed from the apparatus for further processing. Again, the gases exit from the top of each separator, the gases being drawn off into outlet lines 52*a,* 52*b,* by respective fans 54*a,* 54*b.* A portion of the gases in these outlet lines are reintroduced into the dryers 29*a,* 29*b,* via feedback lines 56*a,* 56*b* respectively. The rest of the gases are now directed to respective pollution control devices 58*a,* 58*b* which remove any particulates carried by the gases. The gases are then exhausted into the atmosphere.

Among other features of the invention is the ability to process up to 100,000 pounds of wood per hour, on an oven dried basis. Also, by using a rotary dryer in the first stage, the applicants provide more opportunity for clumps or clusters of wood strand to be separated out into individual pieces as they begin to dry. This promotes a more uniform drying of the strands, a more uniform distribution of the strands, and a more uniform release of VOC's from the strands which improves the overall efficiency of the system in removing them.

As various changes could be made in the above constructions without departing from the scope of the invention, it is intended that all matter contained in the above description or shown in the accompanying drawings shall be interpreted as illustrative and not in a limiting sense.

In view of the above, it will be seen that the several objects and advantages of the present invention have been achieved and other advantageous results have been obtained.

Having thus described the invention, what is claimed and desired to be secured by Letters Patent is:

1. Apparatus for drying particles derived from wood such as sawdust, wafers, flakes, paper sludge, and strands comprising:

a first drying stage into which wood particles are introduced and through which the particles are conveyed, the wood particles being heated to a first elevated temperature as they pass through the first drying stage to drive off moisture and VOC's from the particles:

a second drying stage into which the wood particles are introduced from the first drying stage, the particles being conveyed through the second drying stage and heated to a second elevated temperature as they pass through the second stage to substantially eliminate any moisture remaining in the particles so the particles can be used in making wood products; and a single combustion means for burning fuel and distributing the resulting heat from combustion to both drying stages for heating wood particles in the two drying stages, the combustion means including means for collecting VOC's driven off from the particles in the first drying stage and heating the VOC's to a temperature at which the VOC's breakdown into shorter chain hydrocarbons which are readily combusted in the combustion means so as to substantially eliminate any VOC's which might otherwise be exhausted to the atmosphere, and the combustion means also substantially reducing the amount of energy required to be supplied to the apparatus to dry the wood particles.

2. The apparatus of claim 1 further including separator means positioned between the first and second drying stages, the separator means separating the wood particles from the VOC's and directing the wood particles to the second drying stage and the VOC's to the combustion means.

3. The apparatus of claim 2 wherein the combustion means heats the inlet to the first drying stage to a temperature of approximately 900° F.

4. The apparatus of claim 3 wherein the combustion means heats the inlet to the second drying stage to a temperature of approximately 700° F.

5. The apparatus of claim 1 which reduces the moisture content of the wood particles from approximately 55–60% at an inlet to the first drying stage to approximately 2% at an outlet from the second drying stage.

6. The apparatus of claim 1 wherein the first drying stage includes a rotary dryer.

7. The apparatus of claim 6 wherein the second drying stage comprises two dryers into each of which wood particles from the first drying stage are introduced, the single combustion means commonly supplying heated gases to both of the second stage dryers to dry the wood particles introduced into each of them.

8. The apparatus of claim 1 which can dry up to 100,000 pounds of wood particles per hour.

9. A drying system for drying particles derived from wood such as sawdust, wafers, flakes, paper sludge, and strands comprising:

a first drying stage into which wood particles are introduced and through which the particles are conveyed, the wood particles being heated to a first elevated temperature as they pass through the first drying stage to drive off moisture and VOC's from the particles:

a second drying stage into which the wood particles are introduced from the first drying stage, the particles being conveyed through the second drying stage and heated to a second elevated temperature as they pass through the second stage to substantially eliminate any moisture remaining in the particles so the particles can be used in making wood products;

separator means positioned between the first and second drying stages for separating the wood particles from the VOC's and directing the wood particles to the second drying stage; and, a single combustion means for burning fuel and distributing the resulting heat from combustion to both drying stages for commonly heating wood particles in the two drying stages, the combustion means including means for collecting VOC's driven off from the particles in the first drying stage directed to the combustion means by the separator means, the combustion means heating the VOC's to a temperature at which the VOC's breakdown into shorter chain hydrocarbons which are readily combusted in the combustion means so as to substantially eliminate any VOC's which might otherwise be exhausted to the atmosphere, and the combustion means also substantially reducing the amount of energy required to be supplied to the apparatus to dry the wood particles.

10. The system of claim 9 wherein the first drying stage includes a rotary dryer.

11. The system of claim 10 wherein the second drying stage comprises two dryers into each of which wood particles from the first drying stage are introduced, the single combustion means commonly supplying heated gases to both of the second stage dryers to dry the wood particles introduced into each of them.

12. The system of claim 9 wherein the combustion means includes a burner for combusting wood bark, wood fines, waste wood, propane, and natural gas to generate gases used to heat the first and second drying stages, as well as the VOC's driven off from the wood particles and returned to the combustion means.

13. The system of claim 11 further including a second separator positioned at an outlet from the second drying stage for separating the wood particles from gases flowing through the second drying stage.

14. The system of claim 13 further including a pollution control device to which gases collected by the second separator are directed.

15. The system of claim 9 wherein the combustion means provides heated gases to each drying stage for an inlet to the first drying stage to be heated to a temperature of approximately 900° F. and an inlet to the second drying stage to be heated to a temperature of approximately 700° F.

16. The system of claim 15 which reduces the moisture content of the wood particles from approximately 55–60% at the inlet to the first drying stage to approximately 2% at an outlet from the second drying stage.

17. A method of drying particles derived from wood such as sawdust, wafers, flakes, paper sludge, and strands comprising:

drying the wood particles in a first drying stage into which wood particles are introduced and through which the particles are conveyed, drying the wood particles including heating them to a first elevated temperature to drive off moisture and VOC's from the particles:

further drying the wood particles in a second drying stage into which the wood particles are introduced from the first drying stage, drying the wood particles in the second drying stage including heating them to a second elevated temperature to substantially eliminate any moisture remaining in the particles so the particles can be used in making wood products;

separating the wood particles from the VOC's as the wood particles pass from the first drying stage to the second drying stage; and, combusting a fuel in a single burner to produce heated gases which are then distributed to both drying stages for commonly heating wood particles in the two drying stages, combusting the fuel including combusting the VOC's separated from the wood particles to a temperature at which the VOC's breakdown into shorter chain hydrocarbons which are readily combusted in the burner so as to substantially eliminate VOC's from any products of combustion exhausted to the atmosphere, combusting the fuel in a single burner also substantially reducing the amount of energy required to be supplied to dry the wood particles.

18. The method of claim 17 which reduces the moisture content of the wood particles from approximately 55–60% at an inlet to the first drying stage to approximately 2% at an outlet from the second drying stage.

19. The method of claim 18 in which the heated gases heat the inlet to the first drying stage to a temperature of approximately 900° F. and an inlet to the second drying stage to a temperature of approximately 700° F.

20. The method of claim 17 in which the second drying stage includes two separate dryers for drying the wood particles, the heated gases produced by the single burner being commonly supplied to both dryers of the second drying stage to dry the wood particles introduced into each of them.

* * * * *